US005120957A

United States Patent [19]

Griffiths

[11] Patent Number: 5,120,957

[45] Date of Patent: Jun. 9, 1992

[54] APPARATUS AND METHOD FOR THE CONTROL AND/OR ANALYSIS OF CHARGED PARTICLES

[75] Inventor: Iwan W. Griffiths, Cardiff, Wales

[73] Assignee: National Research Development Corporation, London, England

[21] Appl. No.: 765,485

[22] Filed: Sep. 25, 1991

Related U.S. Application Data

[63] Continuation of Ser. No. 595,705, Oct. 9, 1990, abandoned, which is a continuation of Ser. No. 464,634, Jan. 5, 1990, abandoned, which is a continuation of Ser. No. 306,214, Feb. 3, 1989, abandoned, which is a continuation of Ser. No. 112,441, Oct. 26, 1987, abandoned.

[30] Foreign Application Priority Data

Oct. 24, 1986 [GB] United Kingdom ..... 8625529

[51] Int. Cl.[5] ..... H01J 49/44

[52] U.S. Cl. ..... 250/282; 250/291; 250/292

[58] Field of Search ..... 250/281, 282, 290, 291, 250/292, 293, 286

[56] References Cited

U.S. PATENT DOCUMENTS

| | | | |
|---|---|---|---|
| 3,527,939 | 9/1970 | Dawson et al. | 250/292 |
| 3,986,024 | 10/1976 | Radermacher | 250/299 |
| 4,540,884 | 9/1985 | Stafford et al. | 250/292 |
| 4,650,999 | 3/1987 | Fies et al. | 250/292 |
| 4,686,367 | 8/1987 | Louris et al. | 250/291 |
| 4,736,101 | 4/1988 | Syka et al. | 250/292 |
| 4,749,860 | 6/1988 | Kelley et al. | 250/291 |
| 4,818,869 | 4/1989 | Weber-Grabau | 250/282 |

FOREIGN PATENT DOCUMENTS

| | | | |
|---|---|---|---|
| 2521778 | 8/1983 | France | 250/290 |

*Primary Examiner*—Jack I. Berman

*Attorney, Agent, or Firm*—Cushman, Darby & Cushman

[57] ABSTRACT

A method of analysis of a gaseous sample comprises the steps of introducing into a quistor a sample of ions characteristic of the gaseous sample, applying a potential to the electrodes of said quistor so that only one ionic species is stable in a trap of said quistor at any given instant, incrementing the potential applied to the electrodes of said quistor so that said ionic species becomes unstable and is ejected from said trap and determining the mass/charge ratio from the measurements of the parameters of said ion trap at the point of instability.

3 Claims, 6 Drawing Sheets

APPARATUS AND METHOD FOR THE CONTROL AND/OR ANALYSIS OF CHARGED PARTICLES

This is a continuation of application Ser. No. 07/595,705, filed on Oct. 9, 1990, which was abandoned upon the filing hereof which is a cont. of Ser. No. 07/464,634 filed Jan. 5, 1990 which is now abandoned which is a cont. of Ser. No. 07/306,214 filed Feb. 3, 1989 which is now abandoned which is a cont. of Ser. No. 07/112,441 filed Oct. 26, 1987 which is now abandoned.

This invention relates to apparatus for and a method of control of gaseous ions and, in particular, to the control of gaseous ions by means of a quadrupole ion storage trap or quistor.

The quistor is related to conventional quadrupole mass filters which are making increasing contributions in the field of mass spectrometry and, like the mass filter, the quistor can perform a number of functions depending on the way it is operated. A quistor consists of three metal electrodes, each being a hyperboloid of revolution, and is conveniently operated with a combination of steady (DC) and radio frequency (RF) voltages. An electrostatic cage is formed by the electric fields within the trap, and it can be shown that a range of mass/charge (m/e) ratios will be stable within the device when ions are created inside the trap, this range depending on the combination of fields used. This gives rise to three modes of operation:

(1) a total pressure mode, in which ions of all m/e values are stable, (2) an individual ion monitoring mode and (3) a mass spectrometric mode, in which the voltages are scanned in such a way as to being only one m/e value at a time to the detector.

More recently, a quistor has been constructed with an improved scanning scheme and which uses helium collision gas to demonstrate enhanced sensitivity and mass resolution. (European Patent 0113 207).

According to the present invention there is provided a method of analysis of a gaseous sample comprising the steps of introducing into a quistor a sample of ions characteristic of the gaseous sample, applying a potential to the electrodes of said quistor so that only one ionic species is stable in a trap of said quistor at any given instant, incrementing the potential applied to the electrodes of said quistor so that said ionic species becomes unstable and is ejected from said trap and determining the mass/charge ratio from the measurements of the parameters of said ion trap at the point of instability.

An embodiment of the invention will now be described by way of example with reference to the accompanying drawings in which.

Figure 1:
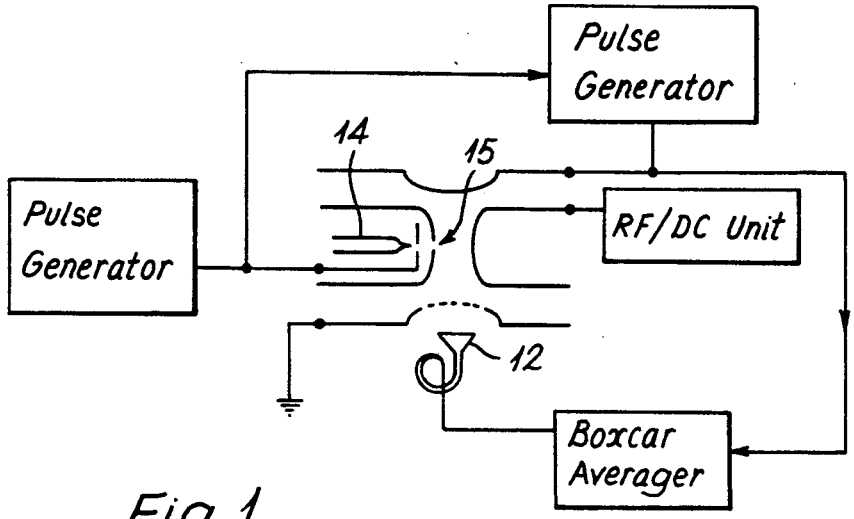
FIG. 1 is a schematic drawing and circuit arrangement of a prior art quistor.
Figure 2:
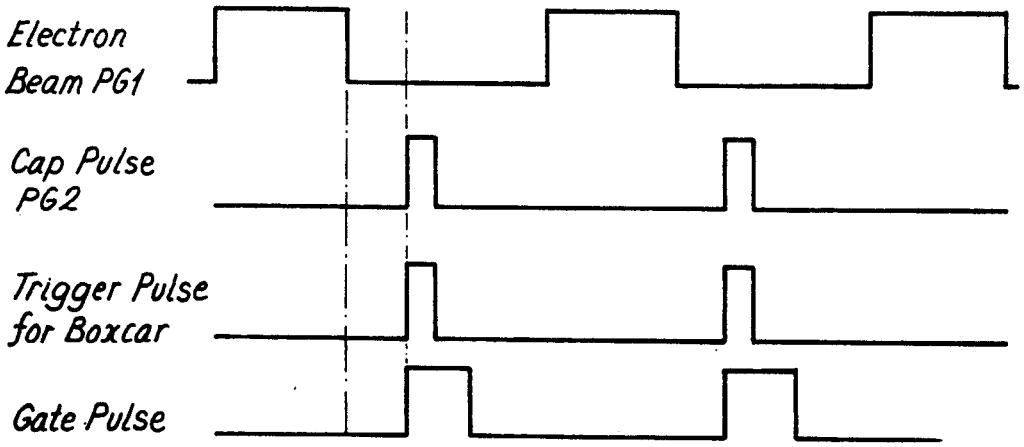
FIG. 2 is a timing diagram associated with the quistor of FIG. 1.

One prior art scheme for the quistor was the ion storage mode. In this case, a burst of electrons is admitted into the trap, thereby creating a range of ion species in the trap characteristic of the sample gas (FIG. 1). Referring to the Mathieu stability diagram (FIG. 7, line A), it can be seen that the use of a specific scanning line selects ions of only one mass at a time. The other ions cannot be trapped and are lost from the trap. Detection of the stored ions is achieved by pulsing the ions out of the trap by means of a voltage pulse applied to one of the cap electrodes. The ions pass through perforations in the cap electrode and then impinge on a Faraday plate collector or (as shown) an electron multiplier. To operate the system properly it is important to work according to a strict timing schedule (FIG. 2). The cycle begins at A with the electron beam pulse applied for a given period to create various ions in the trap.

The period for which the electron beam is kept on could be varied in accordance with the ambient pressure. The electron beam is then turned off (at point B) and the system is allowed an interval during which the ions are sorted according to their m/e values. Ions with a,q values outside the stability region will migrate to the periphery of the trap and will be lost. After a set delay time, a short cap pulse is applied (at C) to eject the ions which were stable onto the electron multiplier. Simultaneously, it is required to generate a gate pulse complementary to the cap pulse so that ion detection is only registered when the cap pulse is applied. If this precaution were not taken, ions being rejected by the trap during the interval BC would also be registered by the detection system. A boxcar detector is convenient to use in this capacity since the gate pulse width and delay are variable and can be triggered on the leading edge of the cap pulse. The cycle then repeats starting at D. Conveniently the time interval AB may be a few milliseconds long at pressures of $10^{-6}$ torr so that the maximum repetition rate will be a few hundred per second.

Various prior art detection schemes such as a frequency-tuned detection circuit coupled between the quistor end caps exist. The detection circuit is balanced with no ions in the trap. When ions are created at low pressure (approximately $10^{-9}$ torr) and stored, their presence can be detected as a result of their motion producing an induced alternating potential provided that the frequency of their secular motion is equal to that of the tuned circuit. The technique used is not ideal since at resonance for a particular species there are other ions also in the trap. When the RF amplitude is scanned (to bring different ions into resonance) it is possible for lower mass ions to be rejected from the trap while higher mass ions are being monitored. Consequently, the environment within the trap changes during the scan and errors must be expected due to this cause.

The mass-selective ion ejection technique outlined above is preferable since only one species is stable in the trap at any given time.

No commercial devices using either of the above detection schemes have appeared because they have been difficult to implement and have given unsatisfactory performance, particularly in comparison with the quadrupole mass filter.

In a practical embodiment, there are geometric errors in the shape of the electrode surfaces which introduce higher than second-order terms in the expression for the potential. Higher order terms in the potential resulting from field errors can cause ions which are nominally stable to absorb energy so as to be lost from the device. It can be shown that hexapole terms cause ion resonances for values of a and q along the lines $$\beta_r=\tfrac{2}{3} \text{ and } \beta_r+\tfrac{1}{2}\beta_z=1$$

where $\beta=2\omega_o/\omega$, $\omega_o$ is the fundamental ion frequency and $\omega$ is the RF frequency.

Similarly, octopole terms cause resonances along the $\beta_r=\frac{1}{2}$, $\beta_r+\beta_z=1$ and $\beta_z=\frac{1}{2}$ lines.

These non-linear resonances occur with great profusion near the bottom apex of the stability diagram. In fact, the $\beta_r+\frac{1}{2}\beta_z=1$ and $\beta_r+\beta_z 1$ lines actually intersect at the bottom vertex of the stability diagram which is where the quistor is usually used. Investigations showed that these lines give rise to a peak shape for the m/e 28 with four major "dips". One dip corresponds to the line $\beta_r=\frac{2}{3}$, a second was identified as $\beta_r+\beta_z=1$ and a third as $\beta_r+\frac{1}{2}\beta_z=1$. The fourth was not identified.

In the prior arrangement of EP 113209 some improvement and simplification of the system is possible by creating a wide range of ions in the trap initially, and then scanning the voltages on the trap so that successive ion masses become unstable as they traverse the boundary of the stability diagram. The ions are detected by a channel electron multiplier situated behind one of the end caps without the necessity to pulse out the ions. This is because the ions become unstable in the z directions whilst remaining stable in the r direction. It has been shown that the presence of helium collision gas at a pressure of $10^{-3}$ torr has the effect of causing the ions to migrate to the centre of the trap and this increases sensitivity and resolution. It is clear however that errors may arise in quantitative mass spectra since a wide range of ion m/e values are trapped simultaneously in the trap initially. The efficiency of trapping is known to be a function of mass and there may be other mass-dependent errors when ions with differing m/e values are in the trap simultaneously.

Figure 4:
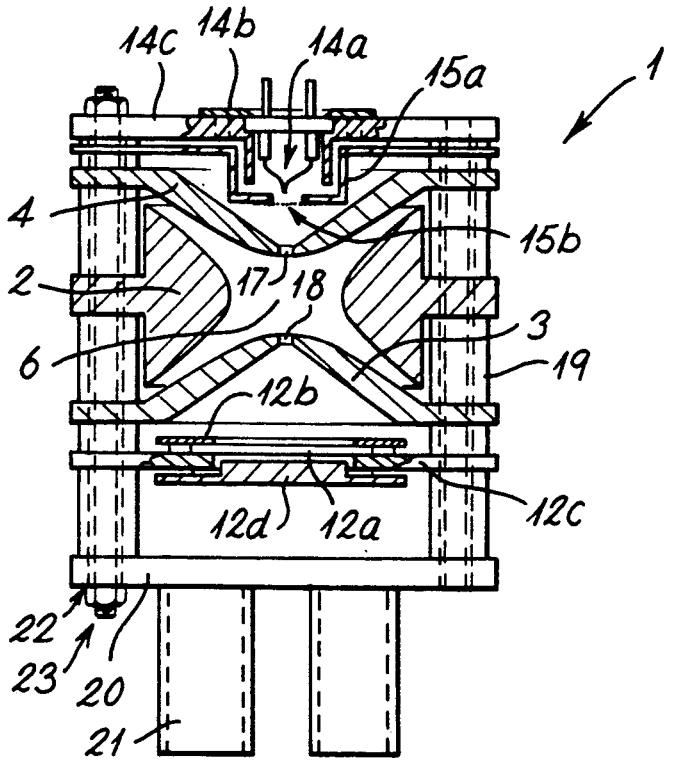
FIG. 4 is a cross-sectional view of a practical embodiment of a quadrupole ion storage trap.
Figure 7:
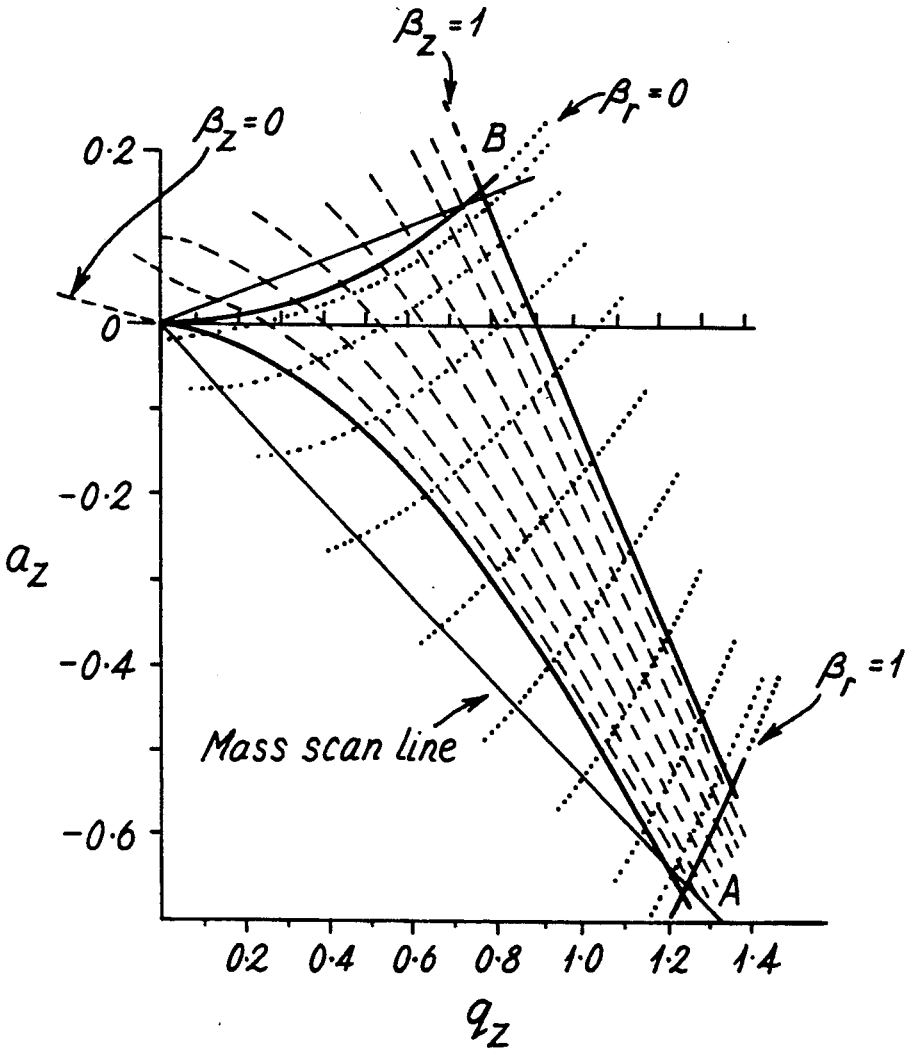
FIG. 7 is a stability envelope for an ion trap mass spectrometer of the type used in the present invention.

A quadrupole ion storage trap in accordance with an embodiment of the present invention is shown at 1 on FIG. 4. The trap has a ring electrode 2 and two end cap electrodes 3 and 4. A radio frequency (RF) voltage generator 5 is connected to the ring 2 and end caps 3 and 4 so as to produce a potential difference of U+V sin $\omega t$ between the ring and the end caps. This produces a quadrupole electric field in the region bounded by the electrodes and forms an ion trapping volume 6. This region has a minimum vertical dimension $z_o$ and a minimum radial dimension $r_o$ both measured from the centre. By solving the equations of motion for an ion moving in the quadrupole electric field, the stability diagram of FIG. 7 is obtained. In order for an ion to have a bounded trajectory, the values of the parameters a and q must be within the limits defined by the stability envelope. These parameters are defined by the following equations:

$$a_z = \frac{-8neU}{mr_o^2\omega^2}$$

$$q_z = \frac{4neV}{mr_0^2\omega^2}$$

where

V=amplitude of RF voltage

U=amplitude of applied direct current (DC) voltage ne=charge on ion m=mass of ion $r_o$=minimum distance of ring electrode from centre of three-dimensional quadrupole ion storage trap $z_o=r_o/\sqrt{2}$ $\omega=2\pi f$ f=frequency of RF Ions may be contained in all coordinate directions when the values of a and q are within the stability region, provided the maximum amplitude of oscillation is less than the internal dimensions of the device. When a=0, ions with values of q between 0 and 0.9 will be nominally stable. Under these conditions, for a fixed radio frequency voltage, ions with a high mass to charge ratio will be situated on the a=0 line nearer the origin and ions with a low mass to charge ratio will be on the same line but with higher q values. This enables the quistor to be operated in a "total pressure mode" and will give an accurate reading of total pressure provided the atomic masses of the gases yields ions with q values less than 0.9 and ions with different values of q are stored with equal efficiency.

Referring now to FIG. 7, which illustrates two mass scan lines and indicates a means of using the quistor as a mass spectrometric device. The mass scan lines are lines representing voltage scanning modes such that a/q=constant i.e. the ratio of DC to RF voltage is a constant.

If the value of the ratio a/q is chosen correctly, the scan line intersects the bottom apex A of the stability diagram and it can then be arranged that only ions with a very narrow range of m/e value will be stable within the device. Again, ions of larger m/e values are situated nearer the origin of the stability diagram. The resolution can be varied by altering the scanning ratio.

The Mathieu stability diagram also shows iso-$\beta$ lines. The parameter $\beta$ and its significance is important; $\beta$ is a parameter which depends only on the values of a and q and is characteristic of the frequencies of ion motion. The ion motion has a fundamental frequency $$\omega_o=\tfrac{1}{2}\beta\omega$$

and also higher frequencies $$\omega 1=\tfrac{1}{2}(1-\beta)\omega \text{ and } \omega 2=\tfrac{1}{2}(1+\beta)\omega$$

plus others. The solution to the equation of motion yields stable motion only for $\beta$ values between 0 and 1.

Hence, the two sets of intersecting lines on FIG. 7 represent frequencies of ion motion along the two perpendicular axes r and z and are denoted $\beta_r$ and $\beta_z$. The mass scan line shown intersects the stable region at approximately $\beta_r=1$ and $\beta_z=0$ so that the fundamental frequency in the r direction is $\omega/2$ and $3\omega/2$. In the z direction the fundamental frequency tends to zero but with a higher frequency. Ions with higher mass to charge ratio (closer to the origin) have frequencies which do not fall in the range $0<\beta_z<1$ and consequently will be unstable in the z direction. Ions which have lower mass to charge ratios will become unstable in the r direction.

$Ar^{2+}$ and $Ar^{+}$ ions in a quistor effectively yielded ions of m/e 20 and m/e 40 respectively and the experimental stability diagrams were determined for a range of working conditions. A typical experiment involved fixing the level of the RF potential $V_o$ and noting the DC levels U at which the ejected ion peak just disappeared. It was found that the bottom apex of the stability diagram was shifted considerably from the theoretical position and moreover the amount of the shift was widely different for the m/e 20 and m/e 40 ions. The apex for the m/e 40 ions was in fairly good agreement with the theoretical prediction but the m/e 20 ions showed marked disagreement with theory. In fact that apex moved from (a,q)=(−0.68, 1.25) to (a,q)=(−0.59, 1.26) in going from m/e 20 to m/e 40. The practical consequence of this is degraded performance as a mass spectrometer, since, if a high resolution mass scan line is selected at the bottom apex, it is possible that an ion of high m/e may be registered at the detector but ions of considerably lower m/e will not be registered at all. This is potentially very serious unless some preventative measures are taken.

Examination of the same results shows that, again, the upper apex of the stability diagram is very much more favourable as regards shift in position of the boundaries as a function of m/e values. The value of a at the apex changed from 0.164 to 0.176 and the change in shape of the boundaries was not so severe as at the bottom apex.

This mode of operation has produced poor peak shapes due to non-linear resonances. Operation of the quistor at the upper apex gives a much improved peak shape since there is only one non-linear resonance line in the vicinity of the apex. This is due to octopole terms and is in fact the line $\beta_r+\beta_z=1$. Consequently, one would expect a peak with only one dip. The dip may be eliminated completely by altering the spacing of the endcap electrodes relative to the ring electrode. This is because a symmetrical spacing error of the two end caps would introduce a fourth order distortion in the potential field. This suggests that a scan line such as B on FIG. 7 would give improved performance although the resolution appears poorer due to the blunter shape of the stability diagram.

The use of this alternative part of the stability diagram also implies the use of smaller voltages for a device of given size. For example, the value of q at the upper apex is approximately 0.76 for mass selective operation as compared to a value of approximately 1.23 at the bottom apex. The ratio of V/U needs to be approximately 10 for operation at the upper apex of the stability diagram.

In accordance with one aspect of the present invention a quistor device operates as a mass spectrometer based on mass selective storage. The DC and RF voltages (U and V cos $\omega t$) are applied to a three-dimensional electrode structure such that only ions over a very narrow range of m/e values are simultaneously trapped. A pulsed electron beam is usually used to produce ions inside the trap. After a short delay, the RF and DC voltages are incremented upwards using a mass scan line intersecting the upper apex of the stability diagram. The trapped ionic species become unstable as a result of the voltage increment since they have now transgressed the boundaries of the stability envelope. The ions pass out of the quistor through holes drilled in one of the quistor electrodes and impinge on a detector. The process is then repeated. Each m/e species becomes unstable successively as the voltages are scanned upwards. The current pulses which emerge from the detector are processed electronically to present the information in intelligible mass spectral form.

Figure 3:
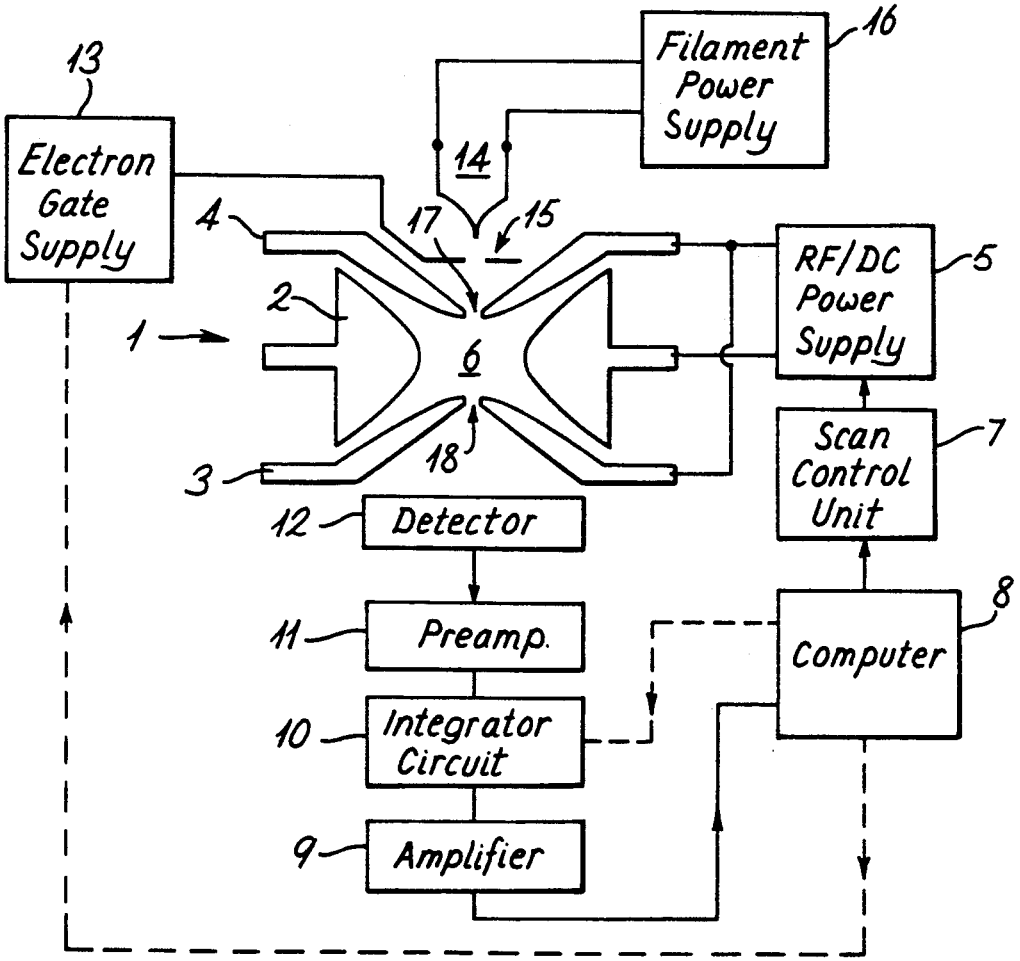
FIG. 3 is a simplified schematic of the quadrupole ion storage trap and a block diagram of the electrical circuits as used in an embodiment of the present invention.

Referring to FIG. 3, ionisation in the trapping volume 6 is produced by an electron beam from a rhenium or tungsten filament 14, heated by an electric current from supply 16. Before entering the quistor the electron beam must pass through a gate electrode 15 which has the effect of gating the electron beam on and off under the control of the electron gate supply 13 and computer 8. The electron beam then passes through a small aperture 17 in the end cap 4. The opposite end cap 3 has a small aperture 18 which allows ions which are unstable to impinge on a detector 12. The signal is then processed by preamplifier 11, integrator 10 and amplifier 9 before being acquired by the computer 8. The power supply 5 which supplies the RF and DC voltages to the electrodes is controlled by a scan control unit 7 and the computer 8. The magnitudes of the RF and DC voltages are scanned digitally in a specific way shown in FIG. 3.

A drawing of the mechanical arrangement of the quistor head 1 is shown in FIG. 4. The filament **14*a* comprises a fine rhenium or tungsten wire supported on two stainless steel legs mounted on a ceramic button. The filament 14*a* fits into a recess in the top plate 14*c* and is held in place by a washer 14*b* secured by screws. The gate electrode 15*a* is situated at a small distance from the filament and has a fine stainless steel gauze 15*b*** covering the aperture in the plate. The quistor structure is quite open; thus the interior pressure will be the same as the exterior pressure. Two assemblies have been designed to be fitted onto 60 mm or 38 mm standard vacuum flanges.

The quistor electrodes are spaced by insulating ceramic tubes; three columns of tubes are placed at angles of 120° around the circular structure. The quistor is mounted on an earthed mounting ring 20 which has integral hollow tubes 21 to allow efficient shielding around wires to the detector assembly. The main structure is held together by M2 studding which slides through a 5 mm external diameter ceramic tube 22 and secured by nuts at both ends of the hollow region 23. The correct spacing of the electrodes is achieved by the use of 8 mm external diameter ceramic tubes 19 which slide over the 5 mm ceramic.

The detector assembly **12(*a*–*d*) comprises a channel plate 12*a*, two stainless steel rings 12*b* and 12*c* for making contact and an electron collector plate 12*d***. This assembly can be removed as a single unit for examination and/or renewal if necessary, as can the filament assembly.

Alternatively, an additional channel plate can be included in the assembly back-to-back with the existing plate so as to give a detector with much higher gain.

Figure 5:
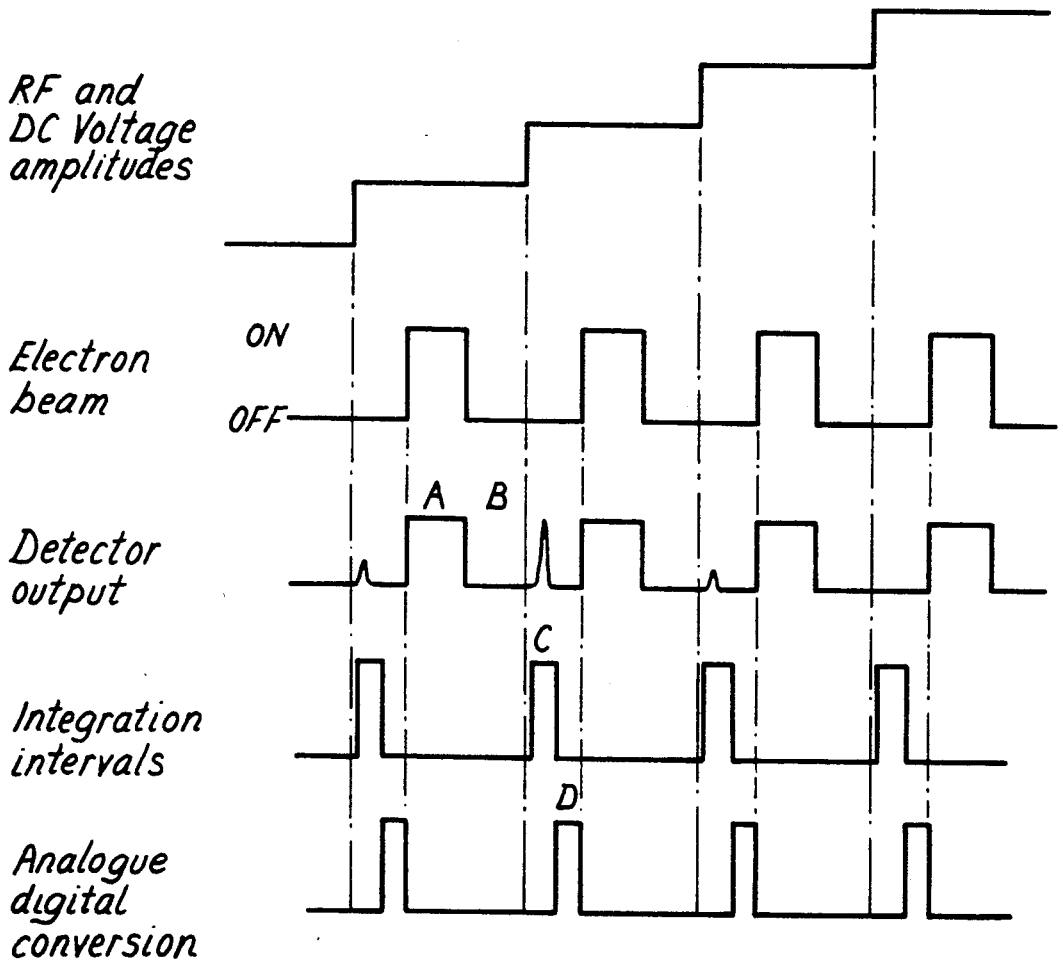
FIG. 5 is a timing and waveform diagram illustrating the operation of this ion trap as a mass spectrometer.

Referring to FIG. 5, this shows how the quistor is scanned and the way in which data is acquired using the system on FIG. 3. In this arrangement the RF and DC voltages are ramped upwards in a staircase fashion under the control of a computer. In a preferred embodiment the RF/DC ratio is chosen so that vertex B of the stability envelope of FIG. 5 is intersected. The operation of a full cycle can be traced by beginning from the period during which the electron beam is on, marked A on FIG. 5. During this time the gate electrode is pulsed positively so that electrons can enter the trapping volume. The electron beam is then turned off and during period B the ions which have been created in the trap are allowed to move under the action of the quadrupole field. If the m/e value for a particular ion species does not yield a point within the stability envelope then that ion species will be lost from the trap. Only those ions with m/e values within a very narrow range are stable and this often corresponds to ions with only a single ionic mass. At the end of the interval B, the RF and DC voltages are incremented upwards. Those ions which were previously stable are now unstable and are lost from the trap predominantly in the axial direction. It is found that the ions arrive at the detector in a pulse with a given pulse width after a given delay. Typically, the pulse width is 50 μs and the delay is 20 μs. During this interval C of FIG. 3, an integrator circuit is enabled which gives an output proportional to the total charge in the output pulse. At the conclusion of this time period, interval D begins during which an analogue to digital conversion is performed on the data. The cycle then repeats. To summarise, the intervals contained in one full cycle are as follows:

| Interval | | |
|---|---|---|
| A | Ion creation time | Variable but usually greater than or equal to 100 μs |
| B | Ion selection time | 100 μs |
| C | Pulse integration time | 100 μs |
| D | Analogue-digital conversion | 10 μs |

The durations of the individual intervals are programmable. It is to be stressed that the hardware required is very simple and that the control and data acquisition systems necessary are very easy to implement with a computer. In fact the quistor has been operated very sucessfully with a BBC 8-bit micro computer. The inclusion of an integrator circuit which is triggered by the computer enables the output pulse C to be acquired very easily while the unwanted output pulse at A does not affect the acquired data.

Referring to FIG. 7, vertex B, the precise value of RF/DC ratio used is arranged such that the range of m/e values trapped is about 0.5 amu. In a preferred embodiment the total number of RF/DC steps possible is 4096. Consider ions (of a given m/e) which are entirely stable in the trapping volume 6. As the scan proceeds, the point representing the ions on the stability diagram moves in a stepwise manner toward the boundary of the stability region. It is found in practice that the edge of the stable region is not perfectly sharp, or in other words, the ions in question produce output pulses from the detector on a number of voltage increments in the scan. As the scan proceeds further, these m/e ions are unstable at all times since the point representing them has moved outside the stability envelope completely.

Referring to FIG. 5 therefore, the output pulses shown during the intervals such as C should be regarded as representing ions all of the same m/e. The total peak for ions of this value of m/e is then the envelope of these output pulses. The resolution obtainable then depends on the sharpness of the stability envelope edge at this point, not the width of the envelope intersected. The maximum attainable resolution with a scan of 4096 steps is clearly 4096 but this will only be obtained if the stability envelope has a perfectly sharp edge. In practice this is not the case and this type of scan has the characteristic that the intensity of the output pulses decreases as the step size is decreased.

Figure 6:
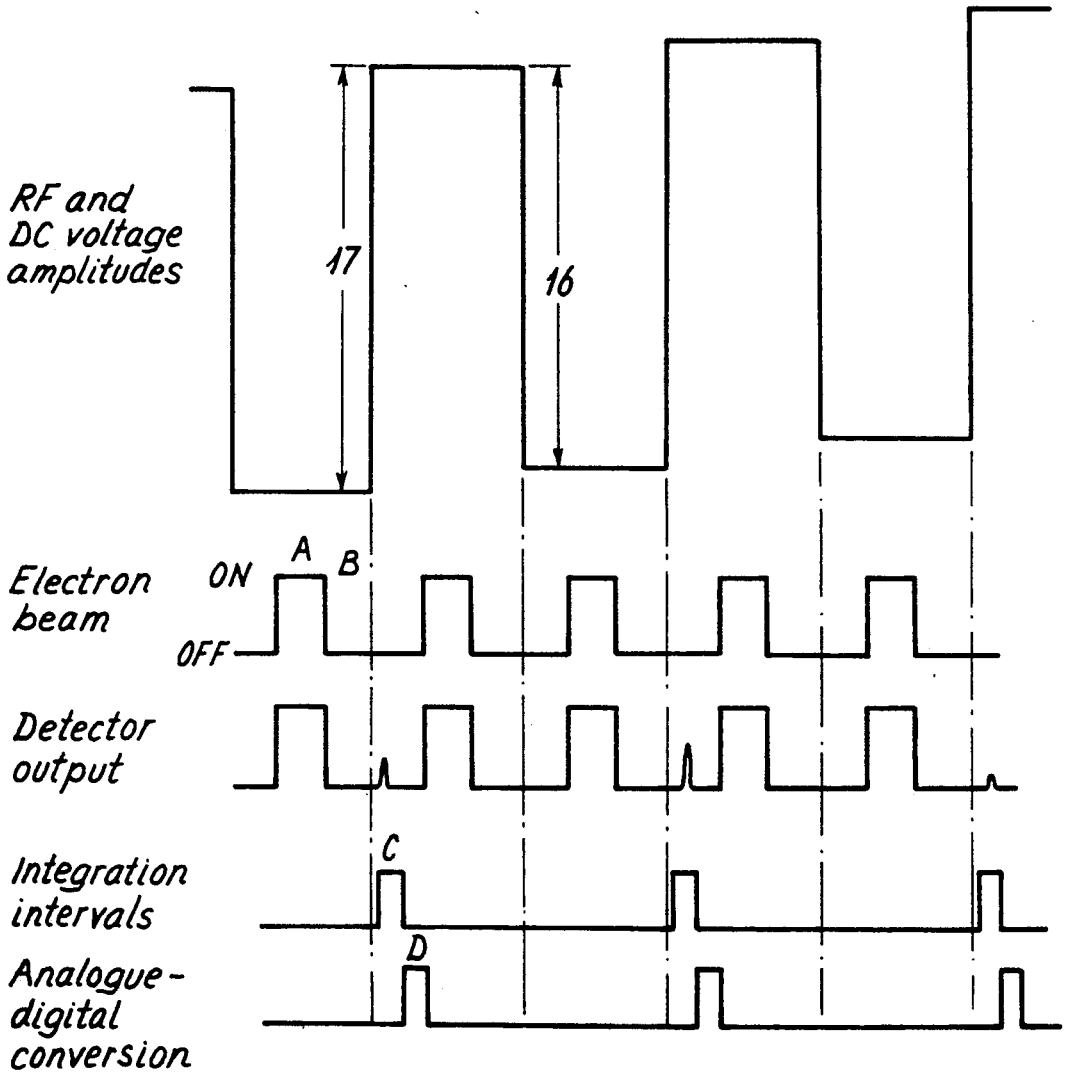
FIG. 6 is a timing and waveform diagram illustrating the operation of this ion trap as a high accuracy mass spectrometer.

Referring to FIG. 6, this shows a means of operating the quistor in order to obtain higher intensity output pulses. The electron beam is gated on and then off as before, but instead of incrementing the RF and DC voltages upwards by one step, the upward increment is 17 steps. The voltages are then decremented by 16 steps, so that the net change is one step. This procedure has the effect of increasing the intensity of the output pulse but the pulse width is approximately twice what it is with the scheme of FIG. 3. The effect on pulse intensity of any lack of sharpness in the edge of the stability envelope is rendered less important by the larger step size used. This can increase the output signal by as much as a factor of 10. To increase the resolution, the RF/DC ratio may be decreased so as to intercept a smaller width of the stability envelope. The optimum situation is where the width intercepted at the top of the stability envelope corresponds to 16 steps approximately in RF/DC voltage, or 1/256 of the full span. If the RF/DC ratio is decreased further, the resolution is improved further at the expense of intensity, but at no time must the width of the stability envelope intersected be less than one step, or 1/4096 of the full span. Note that, in general, the method can be applied with different upward and downward increments than the ones described, and could be used with an upward step of magnitude X followed by a slightly smaller downward step of magnitude X—x, where $X > x$.

I claim:

1. A method of analysis of a gaseous sample comprising the steps of introducing into a quistor, which operates according to a stability diagram, a sample of ions characteristic of the gaseous sample, applying a potential comprising a DC and an RF voltage to the electrodes of said quistor so that only one ionic species is stable in a trap of said quistor at any given instant, choosing a ratio of the DC and RF voltages so that a vertex of the stability diagram is intersected wherein only an upper part of the stability diagram is used, and said incrementing potential step increases the potential upward toward the position above the stability diagram;

incrementing the potential applied to the electrodes of said quistor so that said ionic species becomes unstable and is ejected from said trap and determining the mass/charge ratio from measurements of the potentials applied to said ion trap at a point of instability, introducing into said quistor a second sample of ions characteristic of the gaseous sample, applying another potential to the electrodes of said quistor so that a second ionic species in said second sample of ions different from said one ionic species is stable in a trap of said quistor at any given instant, and incrementing the potential applied to the electrodes of said quistor so that said second ionic species becomes unstable and is ejected from said trap and determining the mass/charge ratio from the measurements of the another potential applied to said ion trap at a point of instability.

2. A method of analysis of a gaseous sample as claimed in claim 1 wherein the DC and RF voltages are ramped upwards in a staircase fashion.

3. A method of analysis of a gaseous sample as claimed in claim 2 wherein the DC and RF voltages are ramped upwards in a plurality of steps and downwards in a lesser number of steps in order to obtain higher intensity output pulses.

* * * * *